US005458693A

United States Patent [19]

Codorniu

[11] Patent Number: 5,458,693

[45] Date of Patent: Oct. 17, 1995

[54] FABRIC FOR PAPERMAKING MACHINES AND THE LIKE

[75] Inventor: Francisco L. Codorniu, Tarragona, Spain

[73] Assignee: Albany Nordiskafilt AB, Halmstad, Sweden

[21] Appl. No.: 240,756

[22] Filed: Nov. 20, 1992

[86] PCT No.: PCT/SE92/00798

§ 371 Date: Sep. 6, 1994

§ 102(e) Date: Sep. 6, 1994

[87] PCT Pub. No.: Pub. No.: WO93/10304

PCT Pub. Date: May 27, 1993

[30] Foreign Application Priority Data

Nov. 22, 1991 [SE] Sweden ..... 9103461

[51] Int. Cl.[6] ..... D03D 23/00

[52] U.S. Cl. ..... 139/383 A; 428/257; 162/901

[58] Field of Search ..... 139/383 A; 428/225, 428/257; 162/DIG. 1

[56] References Cited

U.S. PATENT DOCUMENTS 5,152,326 10/1992 Vöhringer ..... 139/383 A

FOREIGN PATENT DOCUMENTS 0349779 1/1990 European Pat. Off. .
0432413 6/1991 European Pat. Off. .

*Primary Examiner*—James J. Bell
*Attorney, Agent, or Firm*—Kane, Dalsimer, Sullivan, Kurucz, Levy, Eisele & Richard

[57] ABSTRACT

The invention relates to a woven machine clothing comprising at least two warp thread systems (3, 5) and one weft thread system (4). Characteristic of the invention is that the two warp thread systems (3, 5) have been interlaced with each other by thread twisting alternately clockwise (at **4*b*/6*b*) and counterclockwise (4*f*/6*f***).

7 Claims, 1 Drawing Sheet

FABRIC FOR PAPERMAKING MACHINES AND THE LIKE

Figure 1:
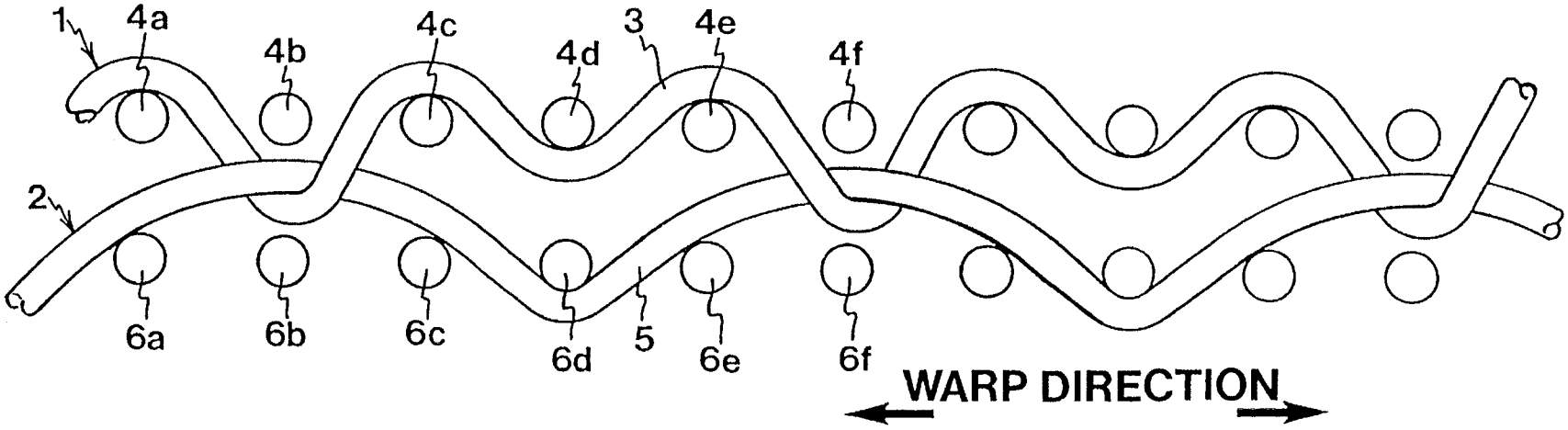

The present invention relates to a woven fabric for use in papermaking, cellulose manufacturing or like machines, said fabric comprising at least two systems of warp threads and at least one system of weft threads.

In the making of paper in a papermaking machine, an aqueous slurry of fibres is flowed on to a horizontally moving forming fabric or into the nip between two running forming elements, of which at least one is a forming fabric. A major portion of the aqueous content of the fibre slurry is dewatered through the forming fabric, and a coherent paper web is formed thereon. The formed paper web is transferred on a press felt into a press section, where more water is squeezed from the web in one or more press nips. Finally, the paper web is transferred to the drying section of the papermaking machine, where, by engaging hot cylinders, it is dried by evaporation of the moisture. The web is brought into engagement with the drying cylinders by means of a dryer fabric.

In the forming of the paper web, the fibre slurry, commonly known as the stock, generally contains above 99% water, of which the major part should be removed by allowing the water to flow through the forming fabric. The throughflow of water takes place in the parts of the forming fabric where the thread material therein does not obstruct such passage. It is however vital that the throughflow areas are very limited, i.e. the fabric must be very fine-meshed, to avoid fibre losses and paper markings, but at the same time the permeability of the forming fabric must be sufficient to allow substantial amounts of water to pass through. Thus, the fabric surface next to the fibre web must be fine-meshed, with many, small throughflow areas, which means that the fabric material must consist of thin threads. At the same time, the fabric must be wear-resistant and dimensionally stable, which means that additional and generally coarser thread material must be included in the forming fabric. This combination of desired properties has been achieved by using several thread systems in one or both directions of the forming fabric.

When the paper web is formed on the surface of the forming fabric, this must be done without reflecting the design of the forming fabric in the paper sheet in the form of a so-called wiremark, which is caused by a non-uniform forming surface. In forming fabrics having several thread systems in one or both directions, these thread systems must be interlaced without interfering with the fine-mesh fabric part that might give rise to a wiremark.

In the drying of the paper web, use is today generally made of monofilament fabrics which, like the forming fabrics, are usually multi-layered with several thread systems in one or both directions. Also in the drying process, an uneven fabric surface may give rise to wiremarks on the paper web.

The above-mentioned interlacing of the thread systems in a forming or drying fabric with several thread systems can be achieved in different ways:

(a) Interlacing by means of separate binder warp threads and/or separate binder weft threads. U.S. Pat. No. 3,885,603 discloses a forming fabric in which the thread systems have been interlaced by special binder warp threads. Swedish Patent Specification 7806764-2 discloses a forming fabric where the thread systems are interlaced by special binder weft threads.

(b) Interlacing multi-thread systems in the form of several woven fabrics where the warp thread from one woven fabric interlaces with the weft thread from another woven fabric. Such interlacing is disclosed in EP 0 349 779.

(c) Interlacing two thread systems in one weaving direction with a thread system, interconnecting these systems, in the other direction of the woven fabric. Such interlacing is disclosed in U.S. Pat. No. 4,071,050.

When using separate binder threads according to case (a) above, these must be very thin to produce minimum interference in the structure. Such a binder thread may, however, be subjected to heavy internal wear in the case of unfavourable operational conditions or choice of pattern.

To combine a fine surface with a wear-resistant and stable structure, the thread systems usually consist of at least one fine thread system next to the paper web and at least one coarser thread system as a lower ply in the fabric. Interlacing these systems entails marking problems when the coarser threads emerge in the surface at the binding points. Also, when the finer surface threads are forced down into the fabric body to interlace with the coarser thread system, craters will easily be formed in the fabric, causing surface non-uniformity.

The invention generally aims at improving the interlacing between several thread systems in a papermaking fabric, where at least two warp thread systems are included in the structure.

A special object of the invention is to provide an interlacing which obviates or at least substantially removes the marking problems in prior-art fabrics used in papermaking machines.

Another object of the invention is to provide an interlacing which does not require any use of separate binder threads.

According to the invention, these and other objects are achieved by means of a fabric of the type stated by way of introduction, comprising at least a first and a second system of warp threads and at least a first system of weft threads, said first warp thread system interlacing with said first weft thread system, the fabric according to the invention being characterised in that adjacent warp threads, one from each of two warp thread systems, twist around each other alternately clockwise and counterclockwise.

To ensure locking, at least one weft thread can be inserted in the woven fabric between each thread twisting motion.

The twisting motion can be achieved by the warp threads being drawn in special leno heddles which during weaving shift the warp threads sideways, i.e. parallel to the weft threads. This leno heddle motion for a warp thread takes place when the warp thread in the warp thread system facing the paper web is positioned below a weft thread interlacing with this warp thread.

By using the inventive interlacing technique with warp threads twisting around each other, the interlacing points between the thread systems can be located on a level at a distance from the paper web to avoid marking problems. Furthermore, the inventive interlacing technique disposes of the need for separate binder warp threads or binder weft threads.

The fabric according to the invention may, in addition to the first and the second warp thread system and the first weft thread system interlaced with the first warp thread system, further comprise a second weft thread system interlaced with the second warp thread system to form two substantially separate woven fabrics. In this case, the interlacing points of the warp threads twisting around each other from the respective woven fabric may be arranged internally in the clothing. In such case, there is no need either of separate binder threads as is previously known and stated above under (a), or of any interlacing between warp threads from one woven fabric and weft threads from the other woven fabric, as is previously known and stated above under (b).

Other features of the invention appear from the appended claims.

The invention will be described hereinafter in some embodiments with reference to the accompanying drawing Figures.

FIG. 1 schematically illustrates a section along the warp threads in a double-layered woven fabric according to one embodiment of the invention.

Figure 2:
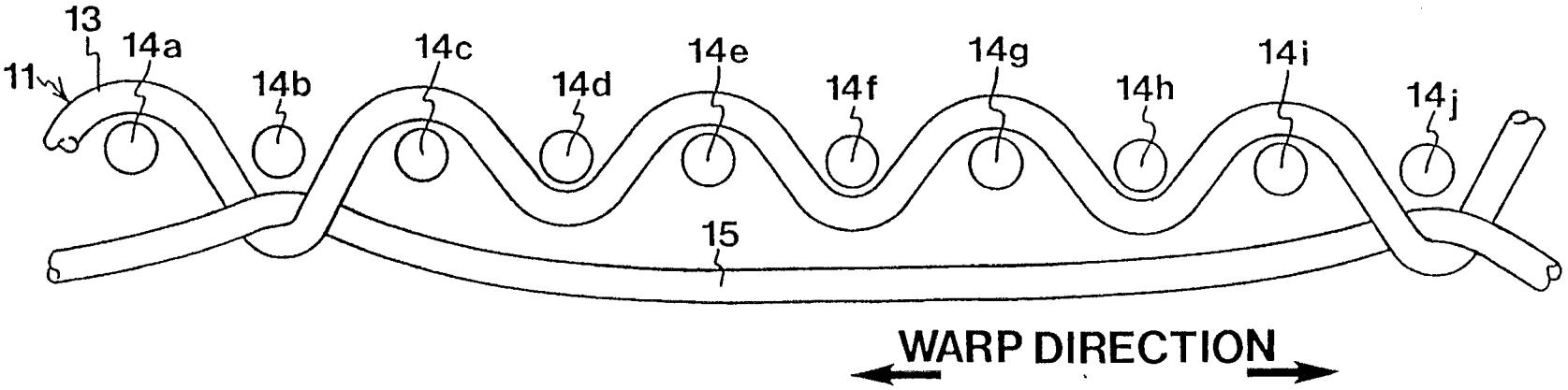

FIG. 2 schematically illustrates a section along the warp threads in a warp-reinforced, single-layered woven fabric according to another embodiment of the invention.

In FIG. 1, the woven fabric, e.g. a forming fabric for the forming section of a papermaking machine, includes a surface fabric or top cloth, generally designated 1, located next to the paper web, and a bottom fabric or bottom cloth, generally designated 2, located under the top cloth 1.

The top cloth 1 consists of a first warp thread system 3 interlacing in plain weave or tabby with a first weft thread system 4. The bottom cloth 2 consists of a second warp thread system 5 interlacing in 3/1 twill with a second weft thread system 6.

When the warp thread 3 of the top cloth 1 during weaving is passed under the weft thread **4*b* of the top cloth, it is at the same time passed down behind the warp thread 5 of the bottom cloth 2, round the underside thereof and thereafter up in front of the warp thread 5 which is located above the weft thread 6*b* of the bottom cloth 2. Further to the right in FIG. 1, the warp thread 3 of the top cloth 1 continues in the weave pattern with the weft threads 4*c*, 4*d* and 4*e*, while the warp thread 5 of the bottom cloth 2 continues in the weave pattern below with the weft thread 6*c* , 6*d* and 6*e*. The warp thread 3 of the top cloth is thereafter passed down in front of the warp thread 5 of the bottom cloth 2, round the underside thereof and thereafter up behind the warp thread 5, at the same time as the warp thread 3 is passed under the weft thread 4*f* and the warp thread 5 is passed over the weft thread 6*f***.

As seen in the warp direction, from the left to the right in FIG. 1, the first thread twisting operation at the weft thread pair **4*b*/6*b* takes place counterclockwise, while the second thread twisting operation or retwisting at the weft thread pair 4*f*–6*f* takes place clockwise. In the continued fabric weaving, the thread twisting operation takes place alternately counterclockwise and clockwise, as indicated farthest to the right in FIG. 1**.

It should be noted that in the woven fabric in FIG. 1 the warp threads 3 of the top cloth 1 do not bind under the weft threads 6 of the bottom cloth 2, and the warp threads 5 of the bottom cloth 2 do not bind over the weft threads 4 of the top cloth. Thus, the interlacing points of the warp threads 3 and 5 twisting around each other are located internally in the woven fabric at a distance from the main surfaces thereof.

Reference is now made to FIG. 2, which schematically illustrates a woven fabric, comprising a single-layered surface fabric or top cloth 11 consisting of a first warp thread system 13 and a first weft thread system 14 interlacing with each other in plain weave or tabby. The single-layered top cloth 11 is reinforced by a second warp thread system 15 which does not interlace with any thread in the weft system.

When the warp thread 13 of the top cloth 11 is passed under the weft thread **14*b*, it is at the same time passed down behind, under and thereafter up counterclockwise in front of the reinforcing warp thread 15 to interlace this thread with the top cloth 11. After such twisting of the warp threads 13 and 15, the warp thread 13 in the top cloth 11 continues in the weave pattern with the weft threads 14, while the warp thread 15 makes a long float under the top cloth 11. At the weft thread 14*j***, retwisting of the warp threads is performed clockwise to their starting position.

The illustrated woven fabrics are merely examples of the invention, which can be carried out in many other different ways within the scope of the appended claims.

Thus, the top cloth is not restricted to a plain weave—although this is preferred—but can be carried out in any desired weave pattern. Nor is it necessary that all warp threads are twisted, as some of them may only interlace with the respective weft thread system.

Furthermore, the thread twisting may take place alternately in another order, with the proviso, however, that the number of thread twistings, e.g. counterclockwise, must be equal to the retwisting clockwise, and vice versa, within a weave pattern repeat.

The same threads need not be twisted around each other all the time, but one thread may first be twisted e.g. counterclockwise and clockwise around an adjacent thread and then be twisted around another adjacent thread.

The inventive woven fabric is generally applicable in papermaking, cellulose manufacturing or like machines. Thus, it can be used both as a fabric (forming fabric, press or drying fabric) and for other purposes, e.g. a base fabric in a needled press felt.

The invention is also usable for woven cloths having more than two layers. In a woven cloth with e.g. three superposed layers, warp threads in one of the outer layers may thus be twisted according to the invention around adjacent warp threads in the opposite outer layer. The warp threads in the intermediate layer might not necessarily be twisted around any warp threads in the adjacent outer layers.

I claim:

1. A woven fabric for papermaking and cellulose manufacturing or like machines, comprising at least a first and a second system of warp threads and at least a first system of weft threads, said first warp thread system interlacing with said first weft thread system, wherein adjacent warp threads from said first and said second warp thread systems twist around each other alternately clockwise and counterclockwise.

2. A woven fabric as claimed in claim 1, wherein at least one weft thread is inserted between a first thread twist and a subsequent retwist.

3. A woven fabric as claimed in claim 1, wherein said fabric further comprises at least a second weft thread system interlacing with said second warp thread system.

4. A woven fabric as claimed in claim 3, wherein said first warp and weft thread systems interlace with said second warp and weft thread systems only by said thread twisting of the warp thread systems.

5. A woven fabric as claimed in claim 1, wherein said second warp thread system does not interlace with any weft thread system.

6. A woven fabric as claimed in claim 1, wherein said first warp and weft thread systems form a top cloth of the fabric facing a paper web.

7. A woven fabric as claimed in claim 6, wherein said top cloth facing the paper web is intended to directly engage the paper web.

* * * * *